US006351243B1

(12) United States Patent
Derneryd et al.

(10) Patent No.: US 6,351,243 B1
(45) Date of Patent: Feb. 26, 2002

(54) SPARSE ARRAY ANTENNA

(75) Inventors: Anders Derneryd, Göteborg; Björn Gunnar Johannisson, Kungsbacka, both of (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/657,999

(22) Filed: Sep. 8, 2000

(30) Foreign Application Priority Data

Sep. 10, 1999 (SE) ..... 9903239

(51) Int. Cl.[7] ..... H01Q 19/06

(52) U.S. Cl. ..... 343/754; 343/700 MS; 343/844

(58) Field of Search ..... 343/754, 844, 343/853, 700 MS

(56) References Cited

U.S. PATENT DOCUMENTS

| | | | | |
|---|---|---|---|---|
| 3,803,625 A | | 4/1974 | Nemit | 343/854 |
| 5,293,176 A | * | 3/1994 | Elliot | 343/797 |
| 5,440,318 A | | 8/1995 | Butland et al. | 343/814 |
| 5,955,994 A | * | 9/1999 | Staker et al. | 343/700 MS |

FOREIGN PATENT DOCUMENTS

| | | | |
|---|---|---|---|
| EP | 0 747 994 | 12/1996 | H01Q/21/24 |
| WO | 89/07838 | 8/1989 | H01Q/1/38 |
| WO | 95/28747 | 10/1995 | H01Q/5/00 |

OTHER PUBLICATIONS

E.D. Sharp, "A Triangluar Arrangemet of Planar–Array Elements that Reduces the Number Needed", IEEE Trans. Antennas & Propaation, vol. AP–9, pp. 126–129, Mar. 1961.

Paul A. Chiavacci and John W. Locke, "Planar Phased Array Antenna Relationships for FFT & Butler Matrix Generated Beamlets with Graphical Display of Results", pp. 196–202, 0–7803–3232–6, IEEE 1996.

1996 IEEE International Symposium on Phased Array Systems and Technology. Revolutionary Developments in Phase Arrays (Cat. No. 96th8175), Proceedings of International Symposium on Phased Array Systems and Technology, Boston, MA, USA, Oct. 15–18, 1996, IEEE, Inc.

Microwave Journal (USA), Jan. 1971, ISSN: 0026–2897, vol. 14, No. 1, pp 41–51, K.H. Hering: "Optimization of TiltAngle and Element Arrangement for Planar Arrays".

* cited by examiner

*Primary Examiner*—Don Wong
*Assistant Examiner*—Hoang Nguyen
(74) *Attorney, Agent, or Firm*—Burns, Doane, Swecker & Mathis, L.L.P.

(57) ABSTRACT

An antenna array for a base station for communication systems presenting a sparse element grid in a one-dimensional scanned array or multi-beam array is presented. The element spacing is primarily governed by scanning in a horizontal direction. In a triangular element grid the individual element spacing in a vertical direction is increased to an order of a wavelength ($d_y \approx \lambda$) without generating grating lobes in visible space for the obtained main lobe, and maintaining about half a wavelength spacing in a horizontal direction ($d_x \approx 0.48\lambda$). This results in a reduction of radiating elements compared to a square grid of radiating elements arranged with a spacing of half a wavelength. By taking into account and limiting the horizontal scan, the vertical spacing may be further increased ($d_y \approx 1.25\lambda - 2\lambda$) to obtain an optimum sparse antenna element grid for a one-dimensional scanned beam or a multi-beam pattern e.g., for a communication system base station.

15 Claims, 5 Drawing Sheets

SPARSE ARRAY ANTENNA

BACKGROUND

The invention relates to an antenna array presenting an optimum sparse design for radio base stations in area covering communication systems.

The demand for increased capacity in area covering communication networks can be solved by the introduction of array antennas. These antennas are arrays of radiating elements that can create one or more narrow beams in the azimuth plane. A narrow beam is directed or selected towards the client of interest, which leads to a reduced interference in the network and thereby increased capacity.

A number of simultaneous fixed scanned beams may be generated in the azimuth plane by a Butler matrix connected to the antenna columns. The antenna element spacing is determined by the maximum scan angle as the creation of interference lobes due to repeated constructive adding of the phases (also referred to as grating lobes) must be considered.

A problem in designing antennas is that the radiating elements in an array antenna have to be spaced less than one wavelength apart in order not to generate grating (secondary) lobes. In the case of a scanned beam, the spacing has to be further reduced. In the limit case when the main beam is scanned to very large angles (as in the case of an adaptive antenna for mobile communications base stations), the element separation needs to be reduced to half a wavelength or less to avoid generating grating lobes within visible space.

The radiating element grid is usually either rectangular (FIG. 1) or triangular (FIG. 4). It is well known that an equilateral triangular element grid reduces the number of antenna elements with about 13% compared to a square grid assuming the same maximum scan angle without generating grating lobes. However, this element grid is not optimized for the one dimensional multi-beam scanned array case. For instance, reference to this can be found in E. D. Sharp, "A triangular arrangement of planar-array elements that reduces the number needed", IEEE Trans. Antennas & Propagation, vol. AP-9, pp. 126–129, March 1961.

The radiating elements in an array antenna are often placed in a regular rectangular grid as illustrated in FIG. 1. The element spacing is denoted $d_x$ along the x-axis and $d_y$ along the y-axis. The beam directions are found by transforming from element space to beam space. The corresponding beam space for the antenna illustrated in FIG. 1 is found in FIG. 2.

In this case the main beam is pointing in the direction along the antenna normal. The beams outside the visible space (i.e. outside the unit circle) constitute grating lobes and they do not appear in visible space as long as the beam is not scanned and the element spacing is less than one wavelength along both axes ($\lambda/d_x>1$ and $\lambda/d_y>1$). For a large array, the number of radiating elements in the rectangular arranged grid is approximately given by $N_R=A/(d_x d_y)$, where A is the area of the antenna aperture.

When the main beam is scanned along the x-axis, all beams in beam space move in the positive direction by an amount, which equals a function expressed as sinus of the scan (radiating) angle. For each horizontal row in a one-dimensional scan in the x-direction we can express the secondary maxima or grating lobes as $$x_m=\sin(\theta_s)+m\cdot\lambda/d_x,\ m=\pm1,\pm2,\ldots$$

wherein $x_m$ is the position of lobe m, $\theta_s$ is the scan angle relative to the normal of the array and $d_x$ is the distance between the elements in the horizontal plane. As the distance between lobes here is $\lambda/d_x$ it will be realized that the largest element distance for a scan angle producing no grating lobes within the visible region is $$\frac{d}{\lambda}<\frac{1}{1+\sin(\theta_{max})}$$

In a case illustrated in FIG. 3, a second beam (grating lobe) enters visible space in addition to the main beam. This may be avoided by reducing the element spacing along the x-axis. When the element spacing is less than half a wavelength (i.e. $\lambda/d_x>2$), no grating lobe will enter visible space independent of scan angle, since $|\sin(\theta)|\leqq 1$.

Radiating elements placed in an equilateral triangular grid are shown in FIG. 4. The vertical element spacing is defined as $d_y$. A corresponding beam space is illustrated in FIG. 5. The element spacing must not be greater than $1/\sqrt{3}$ wavelengths (i.e. a maximum value of $d_y$ is about 0.58 wavelengths) along the y-axis (and $2d_x$ is one wavelength along the x-axis [equal to $d_y\sqrt{3}=0.58\cdot\lambda\sqrt{3}=\lambda$.]) to avoid generating grating lobes for any scan angle. Thus the optimum element spacing, $d_y$, in an equilateral triangular grid of radiating elements is $1/\sqrt{3}$ wavelengths. For a large array, the number of radiating elements in the triangular arranged grid is approximately given by $N_T=A/(2d_x d_y)$. (Also see reference E. D. Sharp mentioned above.) A reduction of $(N_R-N_T)/N_R=13.4\%$ is obtainable for the equilateral triangular grid compared to the square grid assuming the same grating lobe free scan volume. ($N_T=4A/\lambda^2$ and $N_R=2A\sqrt{3}/\lambda^2$.)

However there is still a demand for an optimization of the radiating grid in an array antenna for obtaining a sparse array antenna for communication base station antennas particularly without generating grating lobes in visible space.

SUMMARY

The present invention discloses an antenna array for a base station for communication systems presenting a sparse element grid for one-dimensional scanning of beams or multi-beam patterns, the radiating elements partially filling a predetermined aperture of the antenna for coverage of a sector with a horizontal extension. The element spacing is governed by scanning in the x-direction mainly. In a triangular element grid the element spacing along the y-axis is increased to an order of one wavelength ($d_y\approx\lambda$) still maintaining a desired aperture with low grating lobe interaction, and maintaining half a wavelength spacing along the x-axis ($d_x\approx\lambda/2$). This corresponds to a reduction of radiating element by the order 50% compared to the square grid of radiating elements arranged with half a wavelength spacing. By taking into account and limiting the horizontal scan the vertical spacing may be further increased to obtain an optimum sparse antenna element grid in a created one-dimensional scanned array or a multi-beam array e.g., for communication system base stations.

Furthermore the present invention may utilize electronic down-tilting of the scanned lobes to minimize interference with nearby cells in a communication network when the sparse array antenna according to the present invention is utilized for base station operations.

A one-dimensional scanned or multi-beam antenna device according to the present invention is set forth by the attached independent claims 1, 19 and 20 and further embodiments according to claim 1 are defined by the dependent claims 2 to 18.

SHORT DESCRIPTION OF THE DRAWINGS

The present invention, together with further objects and advantages thereof, may best be understood by making reference to the following description taken together with the accompanying drawings, in which.

DETAILED DESCRIPTION

Figure 6:
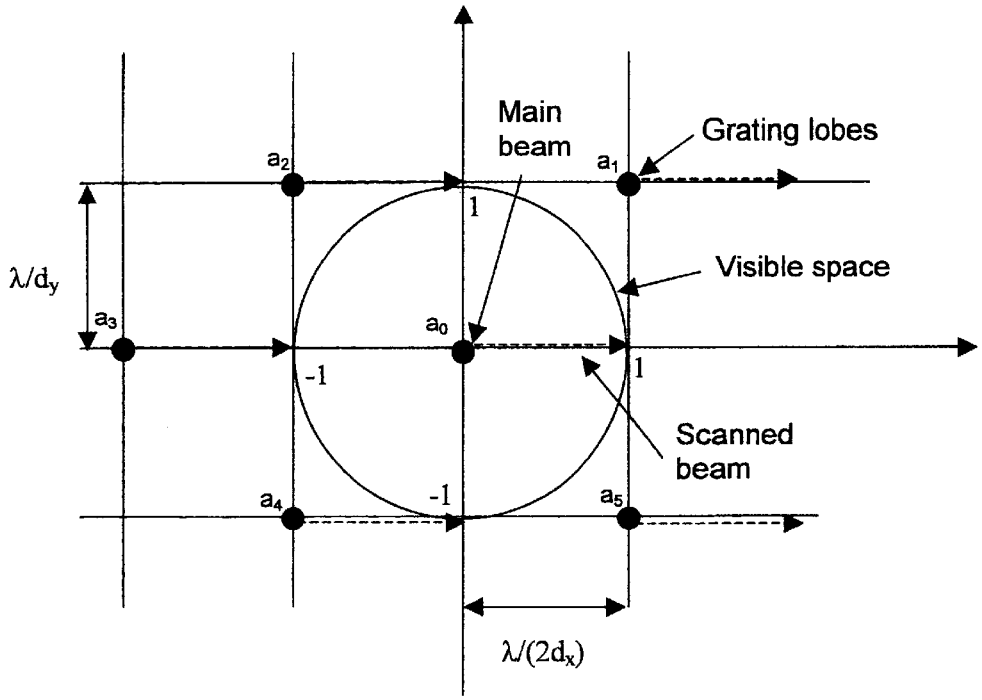
FIG. 6 illustrates an example of beam space for an array according to the present invention.

The invention discloses an optimizing of the radiating element grid in an array antenna device when scanning a beam in one dimension only, e.g. along the x-axis in the illustrated examples. In such cases, the element spacing is governed by the maximum scan angle in the x direction only. In the triangular element grid, the element spacing along the y-axis can be increased to a value from 0.7 of a wavelength to one wavelength ($d_y=\lambda$) without generating grating lobes in visible space, as illustrated in FIG. 6, while maintaining half a wavelength spacing along the x-axis ($d_x$). This corresponds to a radiating element number reduction of 30–50% compared to a grid arranged in a square and having the radiating elements spaced by half a wavelength. The present design results in a simpler and cheaper array antenna.

Figure 1:
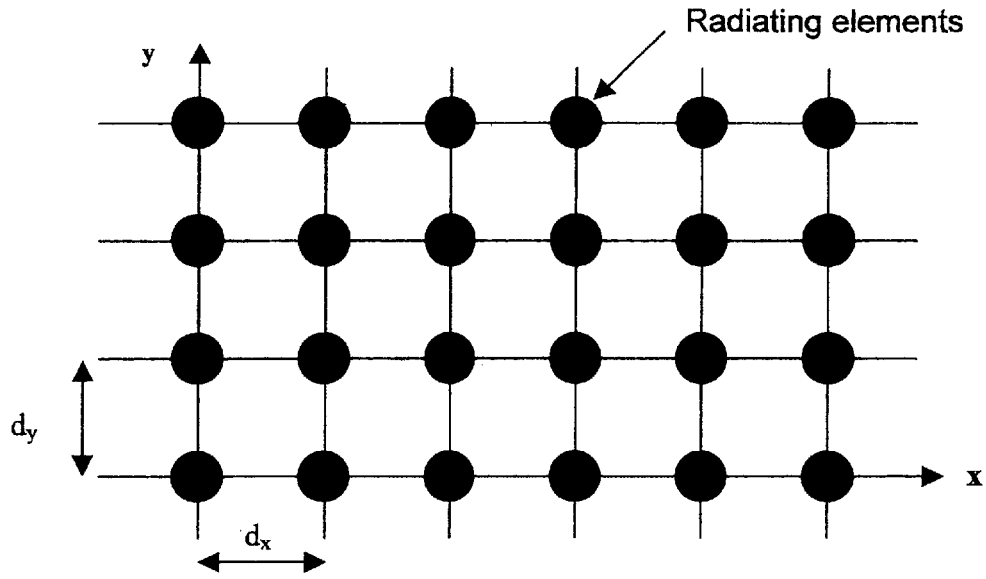
FIG. 1 illustrates an antenna having radiating elements placed in a rectangular grid.
Figure 2:
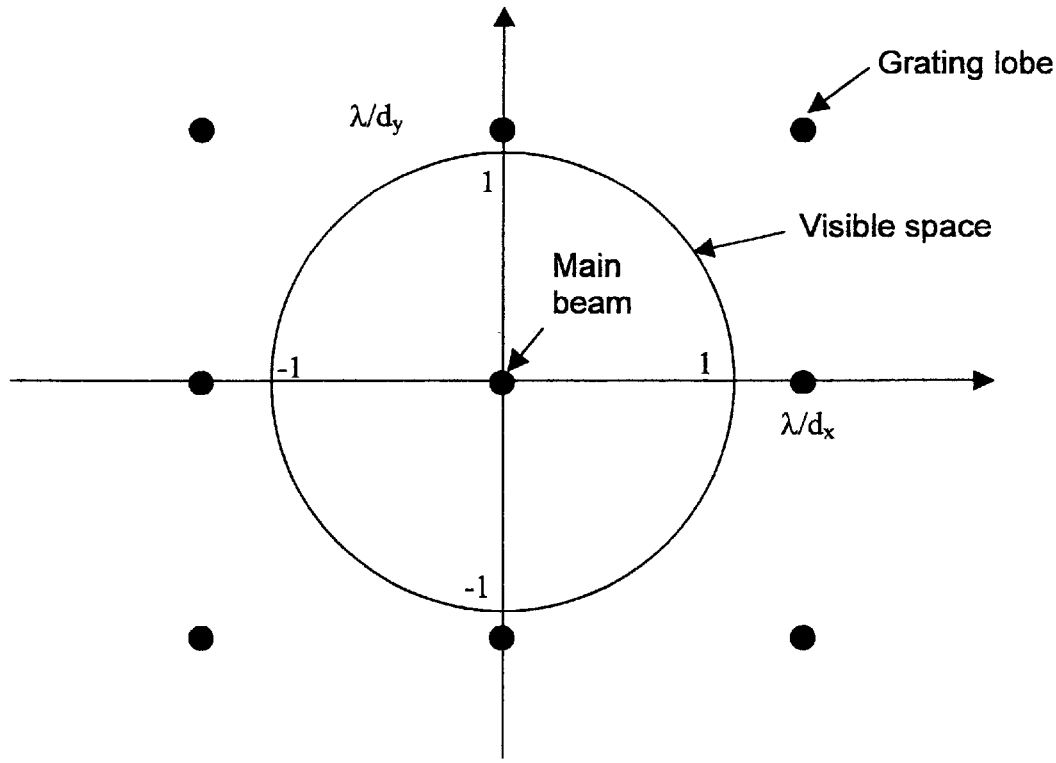
FIG. 2 illustrates beam space for an array demonstrated in FIG. 1.
Figure 3:
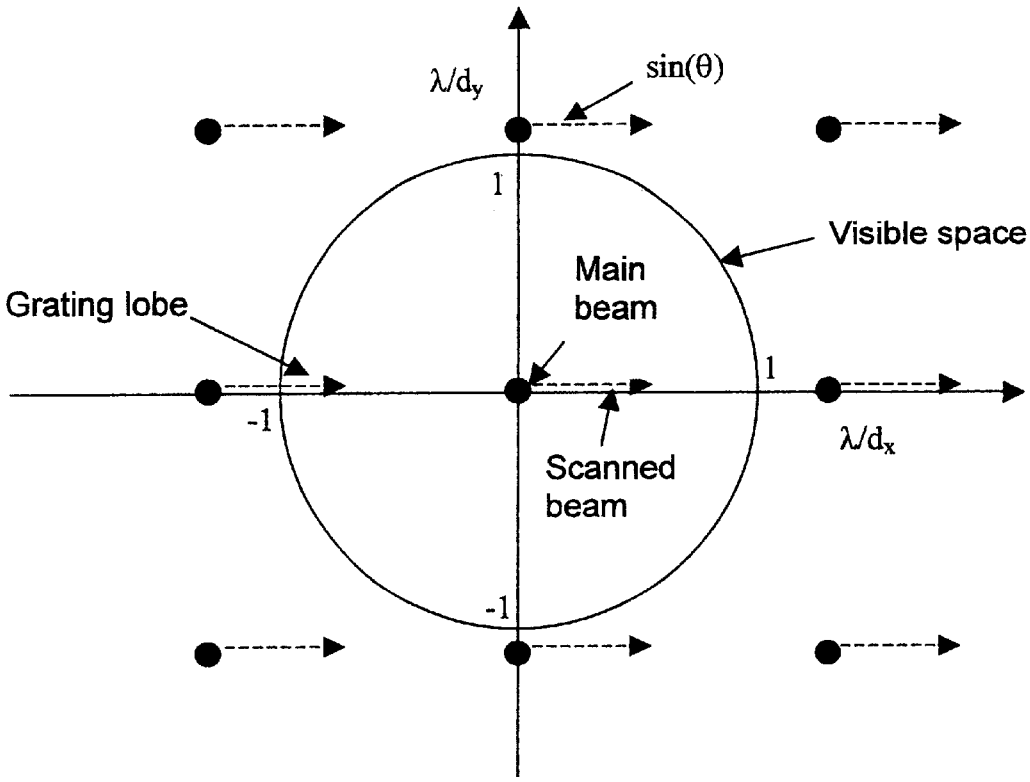
FIG. 3 illustrates the beam space for the antenna illustrated in FIG. 1 when the main beam is scanned along the x-axis.
Figure 4:
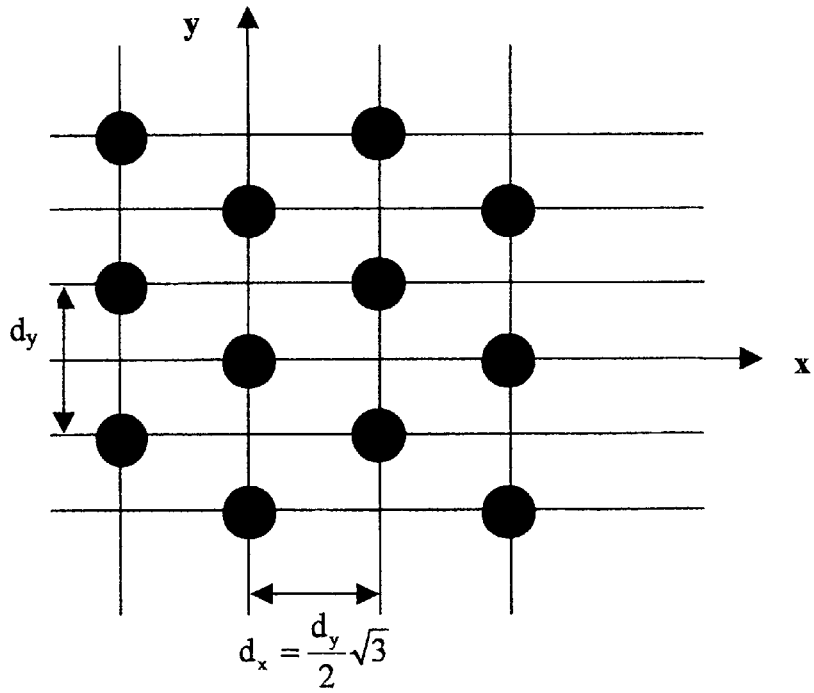
FIG. 4 illustrates an antenna having radiating elements in an equilateral triangular grid.

As illustrated in FIG. 6, the grating lobe comes close to visible space only for the outermost beam directions when using a triangular grid compared to using a rectangular grid. In the latter case, the central beam is most affected by the horizontal grating lobe (compare to FIG. 3).

An advantage with the invention is that it can be utilized in systems where the requirements on the outermost beam positions are less critical from a system point of view. For example, the main beam gain is reduced as a grating lobe starts to enter visible space. In these systems such a gain reduction will be an advantage for the outermost beam positions, in which, in normal cases, an electrical tapering of the lobes may be performed as these outermost beams should be weaker not to unnecessary interfere with nearby cells in a communication network. Furthermore, the grating lobe points in a direction that has low disturbance in the system.

From FIG. 6 it can be seen with a vertical spacing of $d_y=\lambda$ and a horizontal spacing of $2d_x=\lambda$ that the main lobe ao can be scanned out to 90° without having grating lobes $a_2$–$a_4$ entering into the visible space. In beam space it should be kept in mind that if for instance the distance $d_y$ is increased the vertical distance between the grating lobes will decrease as the distance between the vertical grating lobes is $\lambda/(d_y)$. Thus, if the vertical element distance $d_y$ is increased the two upper grating lobes $a_1$ and $a_2$ will move downwards in the drawing, while accordingly the grating lobes $a_4$ and $a_5$ will move upwards. In other words, if $d_y$ becomes larger than $\lambda$, the expression $\lambda/d_y$ will become smaller than the value of 1, which corresponds to the radius of the circle indicating the visible space. Thus, if the main lobe then is scanned out to 90° the grating lobes $a_2$ and $a_4$ will enter into visible space. By tilting the main lobe downwards the grating lobe $a_4$ may still be kept out of visible space. If the scan angle is decreased for instance to the order 60° grating lobe $a_2$ may still be kept out of the visible space for a vertical distance $d_y>\lambda$.

With a design procedure that includes the y-direction element spacing it is even possible to adjust the gain in the outermost beam positions. At the same time, the total occupied area determines the gain in a central beam.

Figure 7:
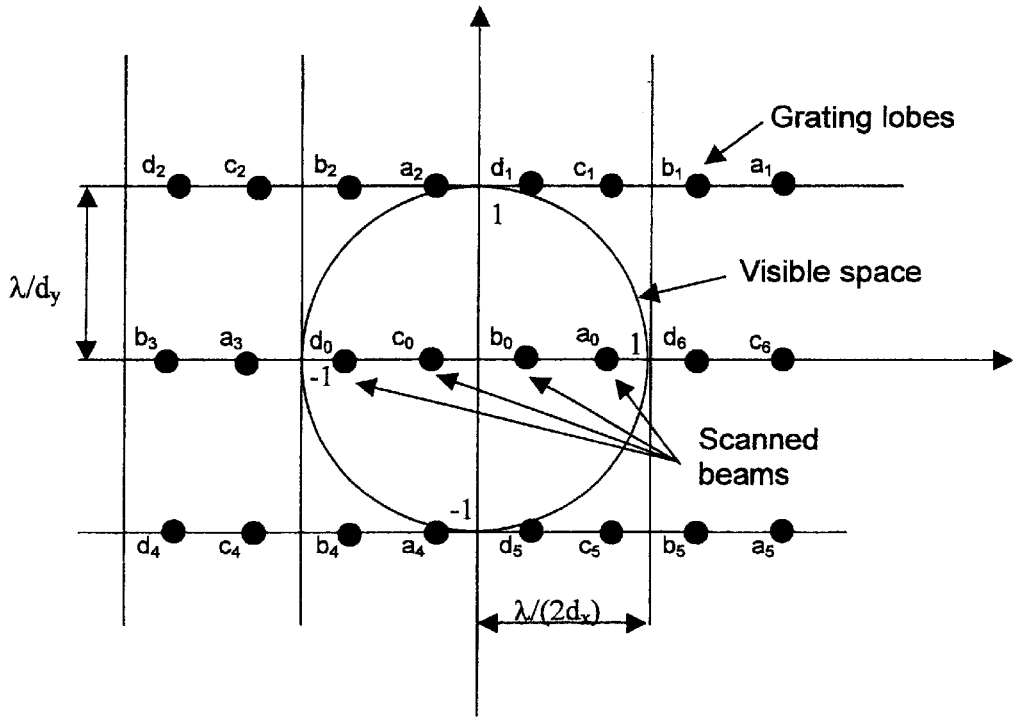
FIG. 7 illustrates an example of beam space for an array antenna with four fixed scanned beams along the x-axis according to the invention.
Figure 8:
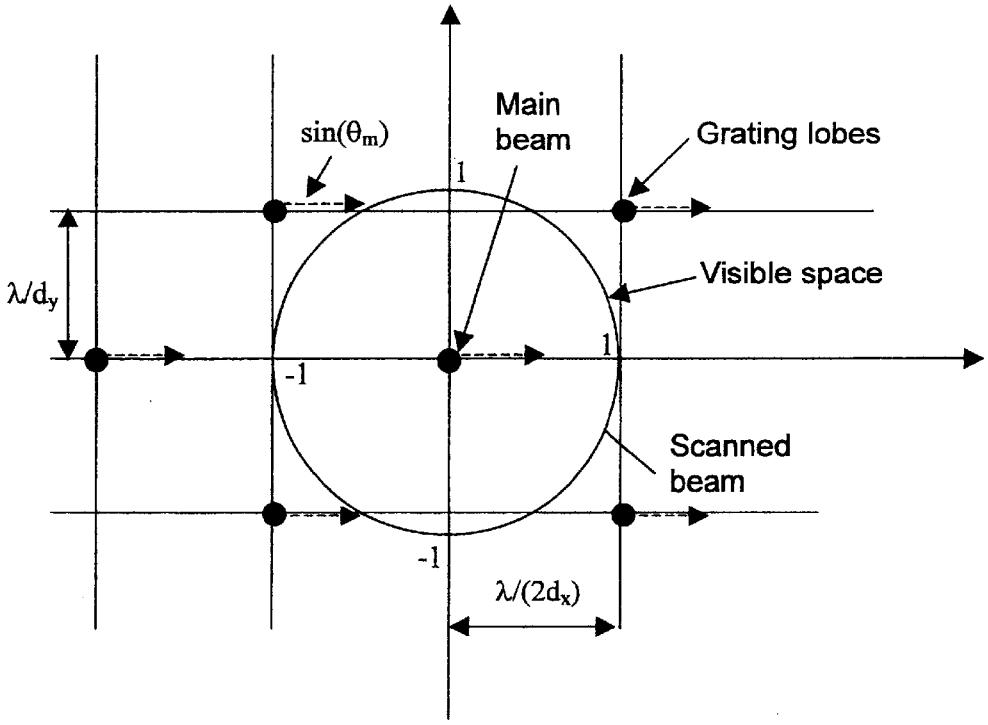
FIG. 8 illustrates an example of beam space for an array antenna with limited scan along the y-axis according to the invention.

A design application for multi-beam array antennas will be demonstrated where a beam cluster is generated along the x-axis. This is illustrated in FIG. 7 where four fixed beams $a_0$–$d_0$, generated by an array antenna connected to a Butler matrix, are equally spaced in beam space. The element spacing is half a wavelength along the x-axis and one wavelength along the y-axis, i.e. $2d_x=\lambda$ and $d_y=\lambda$. Furthermore as discussed above, in the case when the maximum scan angle $\theta_s$ is less than 90 degrees along the x-axis, the element spacing along the y-axis can be increased further without generating grating lobes in visible space. The value mathematically depends on sinus for the maximum scan angle, $\theta_{max}$ as already described in the technical background above. An example is shown in FIG. 8, where the optimum element spacing along the y-axis is determined by $$d_y/\lambda=1/\sqrt{(2\sin(\theta_{max})-\sin^2(\theta_{max}))}.$$

Figure 5:
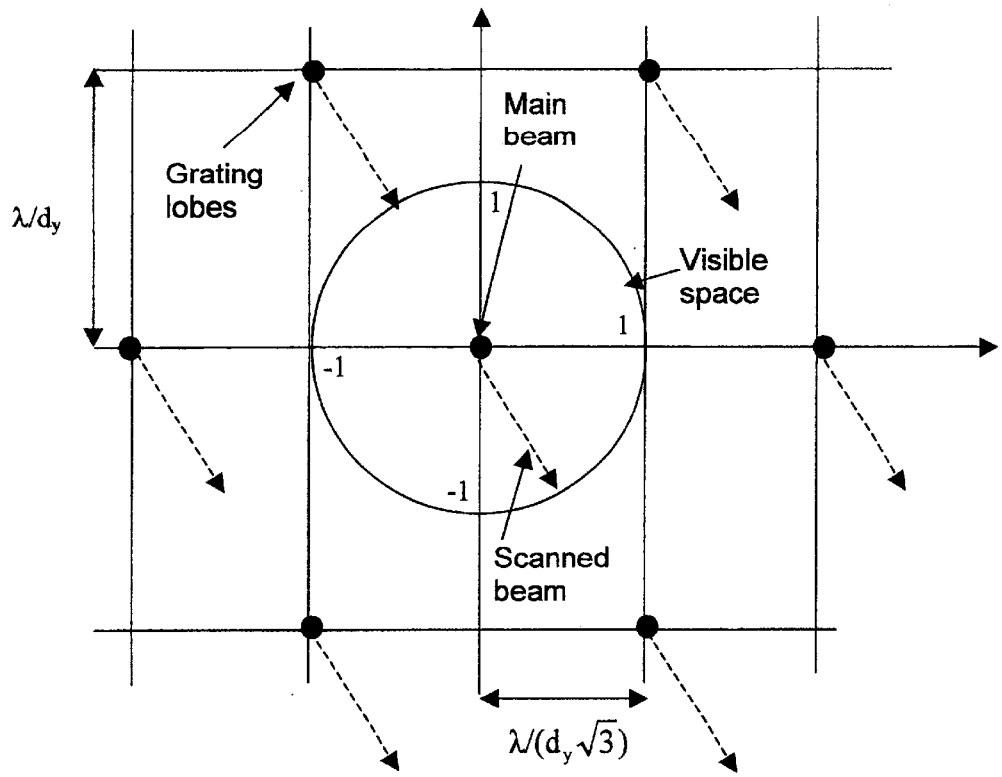
FIG. 5 illustrates the beam space for an equilateral triangular grid with no grating lobes in visible space.

As was indicated in FIG. 5 the central beam may also be scanned in the vertical direction. Thus the entire pattern can electrically be tilted downwards. However, the radiating element spacing then needs to be reduced slightly along the x-axis or the y-axis to avoid too much grating lobe influence in visible space. In FIG. 7 four grating lobes ($a_2$, $a_4$, $d_1$, $d_5$) are positioned along a line which is touching the unity circle, but the grating lobes are far off from the respective scanned central beams $a_0$, $b_0$, $c_0$ and $d_0$ and will therefore have very little impact on the operation of such an antenna and the radiation pattern of the antenna, as those lobes will be pointing at a very high ($a_2$, $d_1$) and very low ($a_4$, $d_5$) angles. The gain reduction of the intended lobes ao, do can be used for adapting the beam to the range requirements. It should however still be kept in mind that the theoretically obtainable vertical distance must still be somewhat reduced as the beams do not define a point but do have a certain extension in beam space. If the vertical distance $d_y$ is increased as demonstrated in FIG. 8 the grating lobes $a_2$, $d_1$ and $a_4$, $d_5$ respectively of FIG. 7 will be moved within the visible space. If then a tilting down of the pattern is introduced $a_2$, $d_1$ will move further into the visible space while $a_4$, $d_5$ still may be kept at the border of the visible space.

Figure 9:
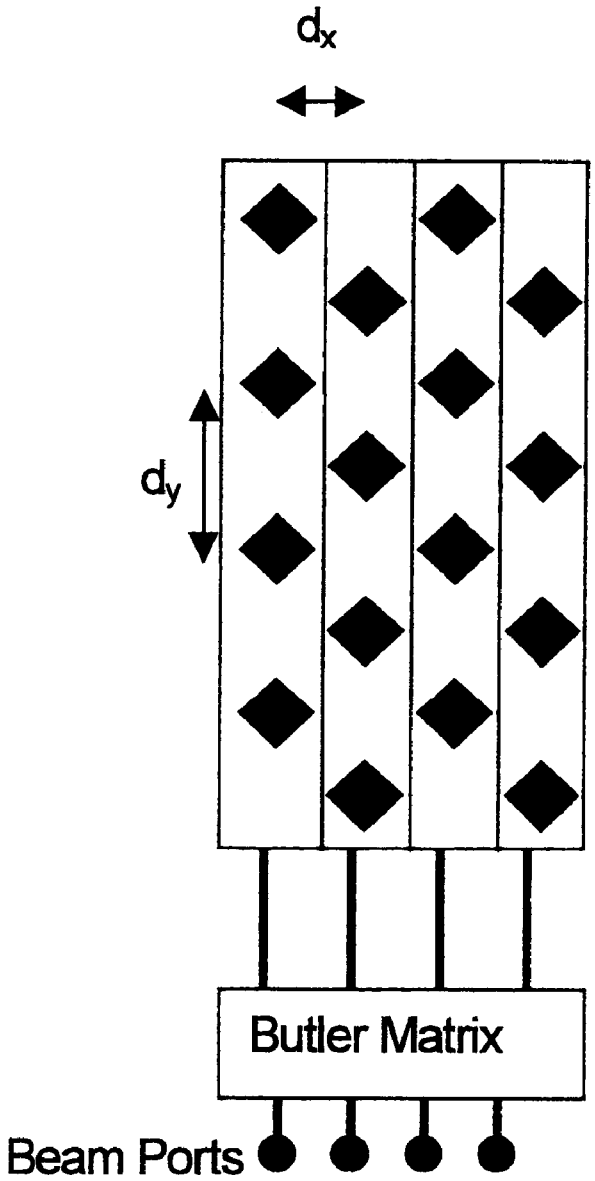
FIG. 9 illustrates an embodiment of the sparse multi-beam array antenna device according to the present invention.

FIG. 9 illustrates an embodiment of the sparse array antenna according to the present disclosed improvements. The antenna of FIG. 9 illustrates a 4×4 element triangular array, which in a conventional way is fed by means of a 4-port Butler matrix. This array presents a typical horizontal element separation $d_x$ of about 0.48λ, but a separation between the antenna elements in the vertical columns will vary dependent for instance of the desired maximum scan angle. In a first embodiment covering around 120 degrees a vertical separation $d_y$ of the radiator elements is about 0.9λ.

The quantity λ corresponds to a wavelength at an upper frequency limit of a used frequency band and the generated beam pattern in this embodiment is electrically tilted down half a beamwidth below the horizon line. In a second embodiment of the present sparse antenna array covering 60 degrees a vertical separation $d_y$ of the radiator elements is about 1.25λ but then no tilting of the beam pattern is used.

It will be understood by those skilled in the art that various modifications and changes may be made to the present invention without departure from the scope thereof, which is defined by the appended claims.

What is claimed is:

1. An array antenna for a radio base station in a communication system comprising a plurality of radiator elements partially filling a predetermined aperture of the antenna for providing coverage of a sector with a horizontal extension, wherein said sector is covered by at least two narrow beams having different fixed scan angles;

said radiator elements of the array are arranged in a triangular lattice, a spacing of which in a horizontal direction is proportional to a maximum scan angle of a main beam in the horizontal direction; and a radiator element spacing in a vertical direction is at least a factor of 0.7 of a beam wavelength to thereby reduce the number of radiator elements and maintain a desired aperture with a low grating lobe interaction.

2. The array antenna according to claim 1, wherein said sector width is more than 90° and the at least two narrow beams are electrically tilted down less than a beam-width below the horizon.

3. The array antenna according to claim 2, wherein the element spacing in the vertical direction is increased to at least about a factor of 0.85 of the beam wavelength and the beam tilt is limited to less than half a beam-width below the horizon.

4. The array antenna according to claim 3, wherein the element spacing in the vertical direction is further increased to at least one beam wavelength with no tilting of the antenna beam pattern introduced.

5. The array antenna according to claim 4, wherein the element spacing in the vertical direction is chosen such that grating lobes are at least partially entering a visible region in beam space to thereby adapt an antenna gain outside a central region of the sector to a reduced range requirement.

6. The array antenna according to claim 5, wherein the central region of said sector is between 40% and 70% of the sector width.

7. The array antenna according to claim 1, wherein the sector is covered by a scanning of the at least two narrow beams.

8. The array antenna according to claim 7, wherein said sector width is more than 90° and the at least two narrow beams are electrically tilted down less than a beam-width below the horizon.

9. The array antenna according to claim 8, wherein the element spacing in the vertical direction is increased to at least about a factor of 0.85 of the beam wavelength and the beam tilt is limited to less than half a beam-width below the horizon.

10. The array antenna according to claim 9, wherein the element spacing in the vertical direction is further increased to at least one beam wavelength with no tilting of the antenna beam pattern introduced.

11. The array antenna according to claim 10, wherein the element spacing in the vertical direction is chosen such that grating lobes are at least partially entering a visible region in beam space to thereby adapt an antenna gain outside a central region of the sector to a reduced range requirement.

12. The array antenna according to claim 11, wherein the central region of said sector is between 40% and 70% of the sector width.

13. The array antenna according to claim 1, wherein said sector width is more than 90° and the at least two narrow beams are electrically tilted down less than a beam-width below the horizon;

the element spacing in the vertical direction is increased to at least about a factor of 0.85 of the beam wavelength and the beam tilt is limited to less than half a beam-width below the horizon; and a central region of said sector is between 40% and 70% of the sector width.

14. An optimized array antenna for a radio base station in a communication system for coverage of a sector with a horizontal extension, wherein said sector to be covered is about 120 degrees; and elements of the array are arranged in a triangular lattice, the individual element spacing of which in a horizontal direction being about 0.48λ and in a vertical direction about 0.9λ, whereby λ corresponds to a beam wavelength at an upper frequency limit of a used frequency band and generated beams are electrically tilted down half a beam-width below the horizon.

15. An optimized array antenna for a radio base station in a communication system for coverage of a sector with a horizontal extension, wherein said sector to be covered is about 60 degrees; and elements of the array are arranged in a triangular lattice, the individual element spacing of which in a horizontal direction being about 0.48λ and in a vertical direction around 1.25λ, whereby λ corresponds to a beam wavelength at an upper frequency limit of a used frequency band.

* * * * *